US006600136B1

(12) United States Patent
Morris et al.

(10) Patent No.: US 6,600,136 B1
(45) Date of Patent: Jul. 29, 2003

(54) OIL HEATER FOR ENGINE OF PORTABLE ELECTRIC GENERATOR

(75) Inventors: Peter Edward Morris, Baltimore, MD (US); Richard Thomas Walter, Baltimore, MD (US); James Michael Weaver, Stewartstown, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/205,035

(22) Filed: Jul. 25, 2002

(51) Int. Cl.[7] ..... H05B 1/00
(52) U.S. Cl. ..... 219/205; 392/497
(58) Field of Search ..... 392/497, 500, 392/441; 219/202, 205, 490

(56) References Cited

U.S. PATENT DOCUMENTS 3,798,072 A 3/1974 Anderson
3,970,816 A 7/1976 Hosokawa et al.
4,242,564 A 12/1980 Kendall
4,279,255 A * 7/1981 Hoffman ..... 607/112
5,210,393 A 5/1993 Shier
5,828,810 A * 10/1998 Frank et al. ..... 392/502
5,990,800 A 11/1999 Tamaki et al.

* cited by examiner

*Primary Examiner*—Thor Campbell
(74) *Attorney, Agent, or Firm*—Harness, Dickey & Pierce, P.L.C.

(57) ABSTRACT

A system for heating fluid in an internal combustion engine. The system includes a portable universal battery pack having an output voltage of a specified voltage rating. Additionally, the system includes a receiving unit that is adapted to removably receive the battery pack and transfer power from the battery pack to an immersion heater. The immersion heater includes a heating element that is at least partially immersed in the fluid. Power from the battery pack is utilized by the heater to heat the heating element, thereby heating the fluid in the engine. The system is adapted to readily use any number of different battery packs from a related line of battery packs, wherein that the various battery packs can have different output voltages.

16 Claims, 5 Drawing Sheets

OIL HEATER FOR ENGINE OF PORTABLE ELECTRIC GENERATOR

FIELD OF INVENTION

The invention relates generally to portable electric generators. More specifically, the invention relates to a utilizing a portable universal battery pack to heat oil housed in a crank case of the portable generator, thereby maintaining the oil viscosity at a level that will enable easy starting of the generator in a cold environment.

BACKGROUND OF THE INVENTION

Portable electric generators utilize a internal combustion engine to provide power to a generator/alternator that produces electrical power that can be used by any electrically operated device, such a power tools. Typically, the internal combustion engine uses oil to cool and lubricate the moving parts of the engine. The oil is contained inside the engine in a crank case and circulated through the engine during operation. Portable generators are commonly used in an outdoor environment, and often remain in the outdoor environment when not in use. If the generator remains in a cold environment for an extended period of time between operation, for example over night, the oil will acclimate to the ambient temperature of the surrounding environment.

As the temperature of oil goes down, the viscosity level of the oil will increase and the oil will thicken. Therefore, if a generator remains in a cold environment for a substantial period of time when not in use, the oil will thicken, which will hinder the flow of oil through the various internal portions of the engine and the movement of parts within the engine. This lack of ease of movement of the engine parts can create significant difficulty in starting the engine.

There are many known devices for heating the crank case oil of large and small internal combustion engines in cold environments. One known method, commonly referred to as a dipstick heater, is a heating element that extends into the crank case through an oil filler port or a dipstick port in the engine block. Known dipstick heaters require an electrical source to which the heater is connected. Connecting the dipstick heater to an electrical source generally requires the use of an extension cord, or is impossible because an electrical source is not available. Since portable electrical generators are intended to provide an electrical power source when a fixed electrical source is not available, the use of a typical crank case oil heater, such as the dipstick heater, is typically not possible.

Therefore, it would be desirable to provide a portable power source that can be used to power a crank case oil heater when a fixed power source is either inconveniently accessible or not available.

BRIEF SUMMARY OF THE INVENTION

In one preferred embodiment of the present invention, a system is provided for heating oil in an internal combustion engine. The system includes a universal battery pack having an output of a specified voltage rating. Additionally, the system includes a receiving unit that is adapted to receive the battery pack and transfer power from the battery pack to an immersion heater. The immersion heater includes a heating element that is at least partially immersed in the oil. Power from the battery pack is utilized by the heater to heat the heating element, thereby heating the oil in the engine.

In another embodiment of the present invention, a method is provided for heating oil in an internal combustion engine.

The method includes attaching an immersion heater to the engine such that a heating element of the heater is at least partially immersed in the oil. The heater is connected to a receiving unit that is configured to receive a universal battery pack having a specified output voltage rating. Additionally, the method includes heating the oil in the engine by utilizing the receiving unit and power from the battery pack to heat the heating element, regardless of the battery pack specified output voltage.

BRIEF DESCRIPTION OF THE DRAWINGS

The present invention will become more fully understood from the detailed description and accompanying drawings, wherein.

DETAILED DESCRIPTION OF THE INVENTION

Figure 1:
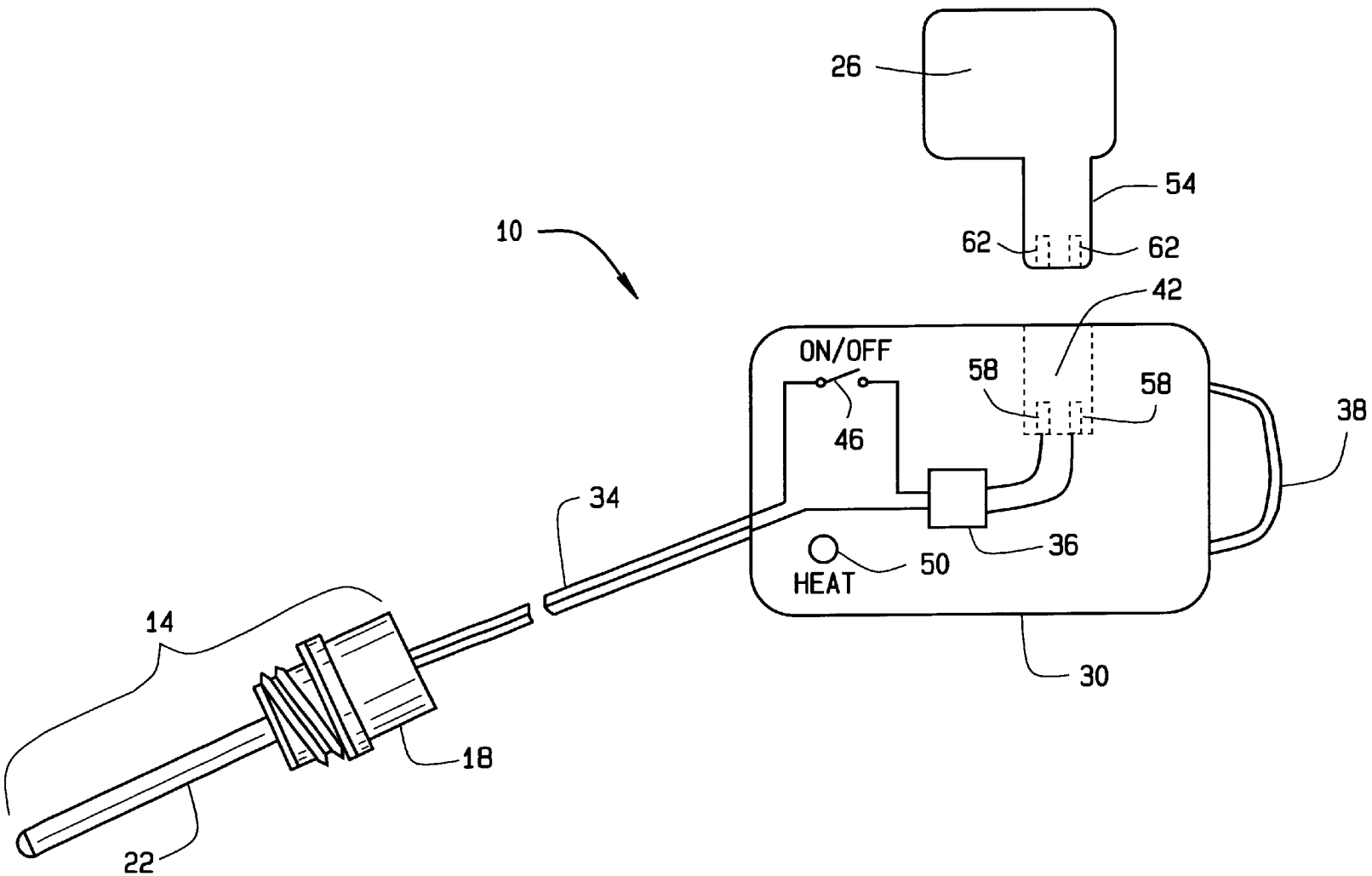
FIG. 1 a block diagram of crank case oil heating system for a portable electric generator, in accordance with a preferred embodiment of the present invention.

FIG. 1 a block diagram of a crank case oil heating system 10 for a portable electric generator, in accordance with a preferred embodiment of the present invention. System 10 can be implemented on any small block gasoline or diesel engine that has a screw-in oil filler configuration. System 10 includes a screw-in sealed immersion type heater 14 that screws into a oil filler port in a block of the engine. Heater 14 includes a threaded cap 18 that is screwed into the oil filler port, and a heating element 22 that extends into a crank case of the engine via the oil filler port. As is well known, the crank case houses oil used to lubricate and cool moving parts of the engine. When heater 14 is installed, heating element 22 is at least partially immersed in the oil. Alternatively, heater 14 can be inserted via a dipstick port in the engine block.

System 10 also includes a removable/portable universal battery pack 26, a receiving unit 30 and a multi-conductor electrical cable 34 connecting heater 14 with receiving unit 30. Cable 34 is preferably made in an armored construction to prevent damage from abuse or the environment. For example, cable 34 may be enclosed in a flexible conduit. Receiver 30 is configured to receive battery pack 26. More specifically, receiver 30 is adapted to receive and utilize a plurality of portable universal battery packs, such as battery pack 26, having various output voltages. For example, receiver 30 can receive and utilize a battery pack 26 rated at 12 volts, and also receive and utilize a battery pack 26 rated at 18 volts, and also receive and utilize a battery pack 26 rated at 24 volts, etc. The rated voltage output of universal battery pack 26 can be, for example, a voltage preferably of 8 volts or greater, preferably ranging from 12 to 24 volts. For example, a NiCd portable universal battery pack of 12, 14.4, 18, or 24 volts can be utilized with receiver 30. It is envisioned that universal battery pack 26 can comprise any universal battery pack commonly used in many cordless power tools, for example the DEWALT® XR PLUS® (Extended Run Time Plus) line of batteries.

In a preferred embodiment, receiver 30 includes a modulator 36 that modulates the voltage of universal battery pack 26 such that a plurality of different portable universal battery packs 26 can perform as a DC power source to provide low current power to heater 14, via cable 34. In an alternative embodiment, receiver 30 does not include modulator 36 and the voltage from battery pack 26 is not modulated. Therefore, heating element 22 will 'heat up' at different rates and to different maximum temperatures depending on the voltage rating of battery pack 26. For example, if battery pack 26 has a rated voltage of 28 VDC, the temperature of heating element 22 will increase at a faster rate and to a higher maximum temperature than if battery pack 26 had a rated voltage of 12 VDC.

In a preferred embodiment, receiver 30 is connected to a frame of the generator using mounting device 38. Mounting device 38 can be any suitable means for affixing receiver 30 to the generator, for example a U-bolt, one or more rivets, one or more screws, or spot welding. Receiver 30 includes a receiving cavity 42 shaped generally in accordance with a neck portion 54 of battery pack 26, an ON/OFF switch 46 and a heat indicator light 50, such as a LED. Receiving cavity 42 removably receives neck portion 54 of portable universal battery pack 26 and includes battery contacts 58 that mate with battery contact receptors 62 in neck portion 54. Battery pack 26 is inserted into receiver 30 by inserting neck portion 54 into receiving cavity 42, such that battery contacts 58 couple, or mate, with battery contact receptors 62. When battery pack 26 is inserted into receiver 30 and ON/OFF switch 46 is positioned in an ON position, voltage will be supplied from battery 26 to modulator 36. Modulator 36 modulates the voltage and outputs a current to heating element 22 via cable 34. The current supplied to heating element 22 causes heating element 22 to heat with a wattage rating sufficient to heat the oil in the engine crank case. When ON/OFF switch 46 is in the on position and battery pack 26 is supplying power to heater 14, heat indicator light 50 will illuminate.

Figure 2:
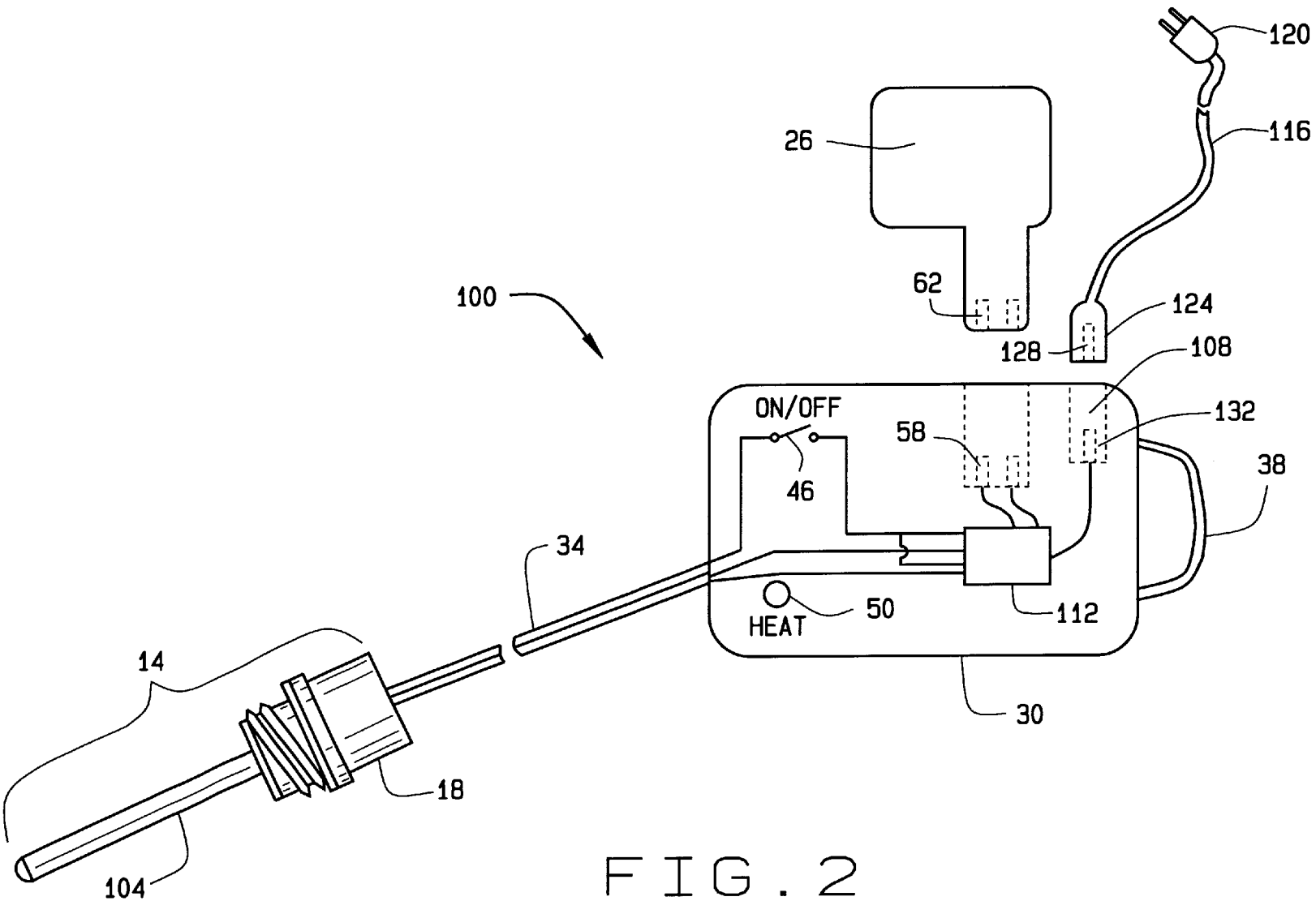
FIG. 2 is a block diagram of the crank case oil heating system for a portable electric generator shown in FIG. 1 incorporating a split coil heating element and a multi-voltage circuit, in accordance with another preferred embodiment of the present invention.

FIG. 2 is a block diagram of a multi-voltage crank case oil heating system 100 for a portable electric generator, in accordance with an alternative preferred embodiment of the present invention. Multi-voltage heating system 100 essentially comprises heating system 10 (shown in FIG. 1) but incorporating a split coil heating element 104, a second receiving cavity 108 and a multi-voltage circuit 112. Heating system 100 operates using either battery power from battery pack 26 or line voltage, e.g. 120V, from a fixed power source (not shown) connected to receiver 30 by a main power cord 116. Main power cord 116 includes a first plug 120 adapted to plug into an AC power source, e.g. a 120 volt outlet, and a second plug 124 adapted to be inserted into second receiving cavity 108. Second plug 124 includes at least one AC power contact receptor 128 that is adapted to mate with at least one AC power contact 132 of second receiving cavity 108.

Figure 3:
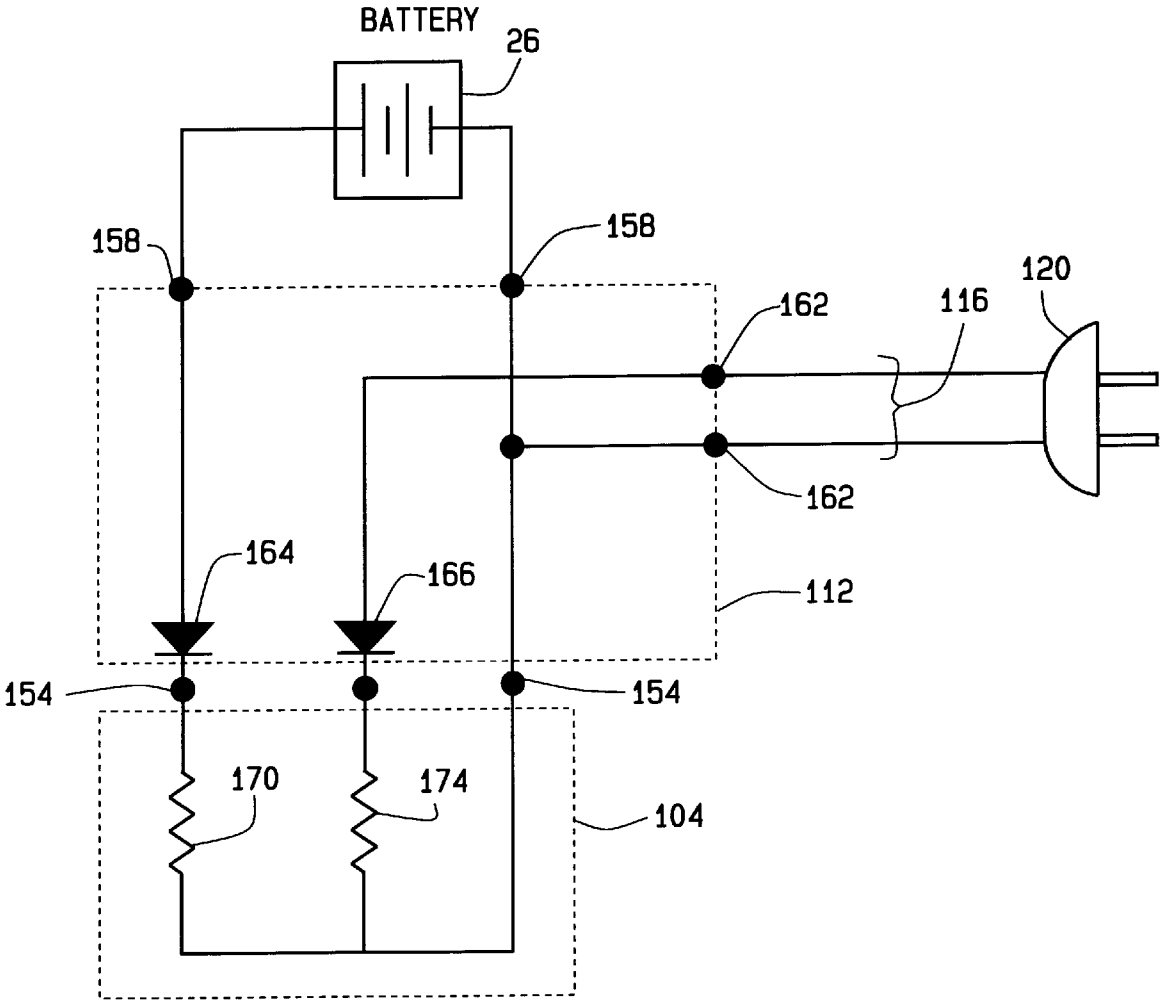
FIG. 3 is a schematic of the multi-voltage circuit shown in FIG. 2.

FIG. 3 is schematic of multi-voltage circuit 112 (shown in FIG. 2). Multi-voltage circuit 112 is connected to heating element 104 at nodes 154. Multi-voltage circuit 112 includes DC input nodes 158 that connect battery pack 26 to multi-voltage circuit 112, and AC input nodes 162 that connect main power cord 116 to multi-voltage 112. DC input nodes 158 represent, electrically, at which points in the circuit the connection is made when battery contacts 58 (shown in FIG. 2) are mated with battery contact receptors 62 (shown in FIG. 2). AC input nodes 162 represent the point, electrically, where in the circuit AC power contact 132 (shown in FIG. 2) is connected with AC power contact receptor 128 (shown in FIG. 2). Additionally, multi-voltage circuit 112 includes a first diode 164 and a second diode 166. Split coil heating element 104 includes a first resistor 170 connected in series with first diode 162, and a second resistor 174 connected in series with second diode 166. Diodes 164 and 166 isolate portable universal battery pack 26 from the first plug 120.

Referring to FIG. 2 and FIG. 3, when battery pack 26 is not inserted in receiver 30 and second plug 124 of main power cord 116 is inserted in second cavity 108, and first plug 120 of main power cord 116 is plugged into an AC power source, power is supplied from the AC power source to split coil heater 104. Current from the AC power source flows through second diode 166 and second resistor 174, thereby generating heat within split coil heating element 104. When battery pack 26 is inserted into receiver 30 and main power cord 116 is not connected to the AC power source, power is supplied from battery pack 26 to split coil heater 104. Current from battery pack 26 flows through first diode 164 and first resistor 170, thereby generating heat within split coil heating element 104. When battery pack 26 is inserted into receiver 30 and an AC power source is connected to multi-voltage circuit 112, via main power cord 116, both first resistor 170 and second resistor 166 dissipate power and generate heat within split coil heating element 104.

First resistor 170 can have any resistive value suitable for dissipating power from battery pack 26 such that battery pack 26 can have various voltage ratings. For example, first resistor 170 can be a 5 ohm resistor that would dissipate 30 watts of power for a 12 VDC battery, 40 watts for a 14.4 VDC battery, or 65 watts of power for an 18 VDC battery. Similarly, second resistor 174 can have any resistive value suitable for dissipating power from the AC power source. For example, second resistor 174 can be a 100 ohm resistor that would dissipate 72 watts of power when connected to a 120 VAC source. Additionally, whenever power is being supplied to split coil heater 104 by battery pack 26, or the AC power source, or both, heat indicator light 50 is illuminated to indicate that split coil heater 104 is generating heat.

Figure 4:
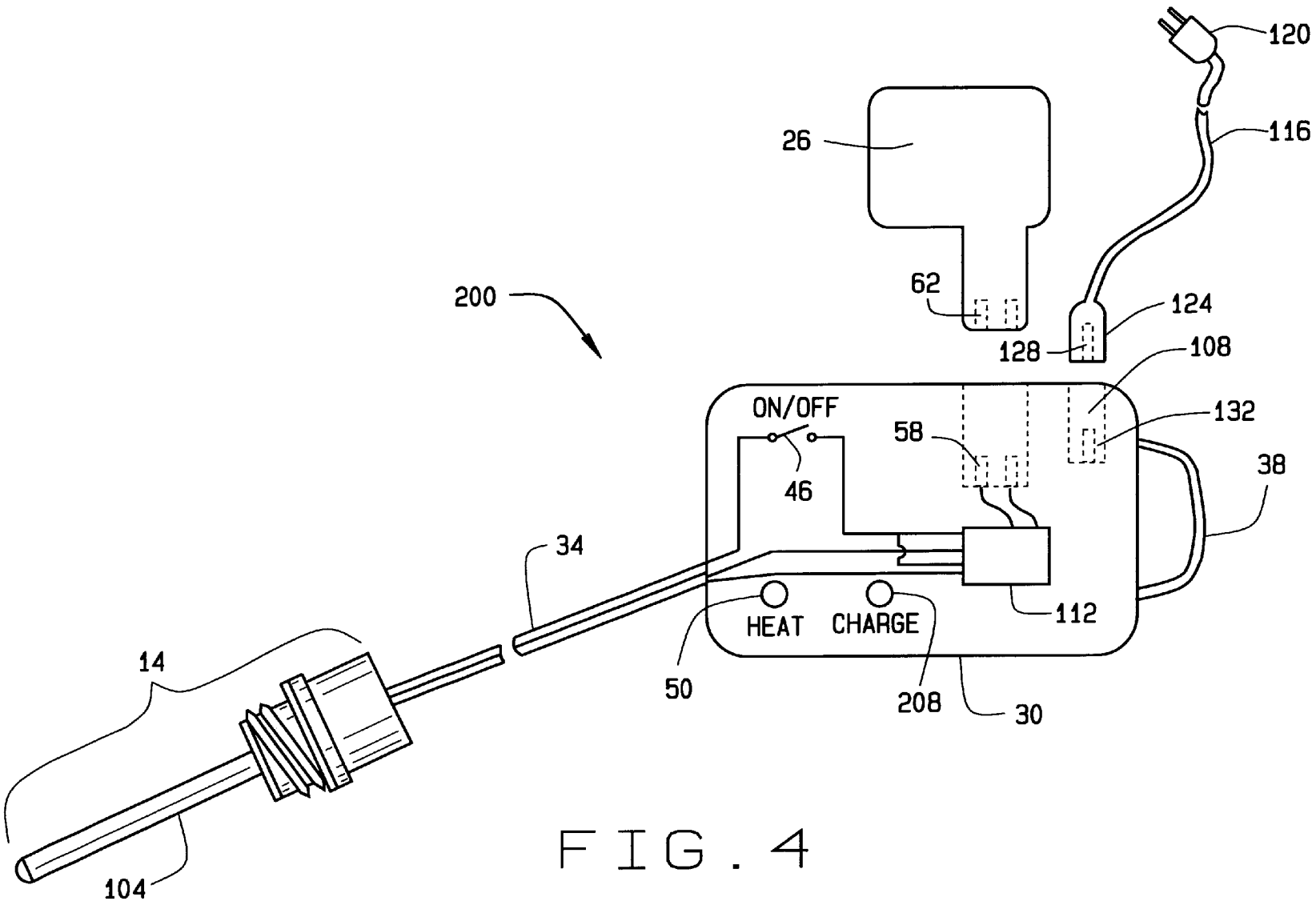
FIG. 4 is a block diagram of the crank case oil heating system for a portable electric generator shown in FIG. 2 incorporating a battery charging circuit, in accordance with another preferred embodiment of the present invention.

FIG. 4 is a block diagram of a multi-voltage and battery charging crank case oil heating system 200 for a portable electric generator, in accordance with another preferred embodiment of the present invention. System 200 essentially comprises multi-voltage heating system 100 (shown in FIG. 2) incorporating a multi-voltage and battery charging circuit 204 that will recharge battery pack 26 using power from the AC power source. To indicate when circuit 204 is charging battery pack 26, heating system 200 includes a charging light 208 that illuminates when battery pack 26 is being charged.

Figure 5:
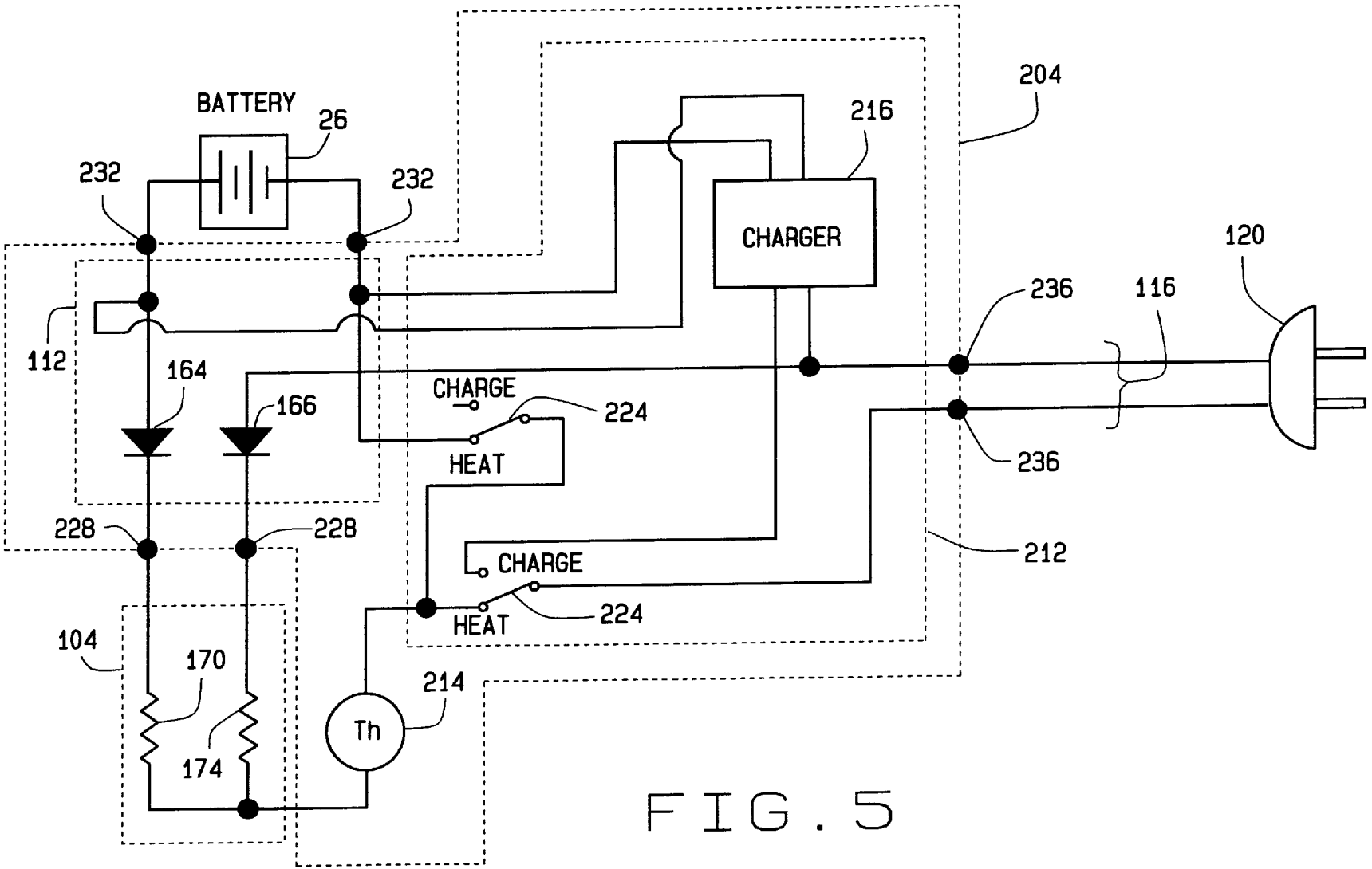
FIG. 5 is a schematic of the multi-voltage and battery charging circuit shown in FIG. 4.

FIG. 5 is a schematic of multi-voltage circuit and battery charging circuit 204 (shown in FIG. 4). Circuit 204 includes multi-voltage circuit 112 (shown in FIG. 3), a battery charging circuit 212, and a thermostat 214. Battery charging circuit 212 includes a charger 216 and a pair of double pole, double throw (DPDT) switches 224. Thermostat 214 monitors the temperature of the oil being heated and disables multi-voltage circuit 212 if the oil temperature exceeds a predetermined temperature. Circuit 204 is connected to heating element 104 at nodes 228. Battery pack 26 is connected to circuit 204 at DC input nodes 232, which represent the connection made when battery contacts 58

(shown in FIG. 4) are mated with battery contact receptors 62 (shown in FIG. 4). Additionally, main power cord 116 is connected to circuit 204 at AC input nodes 236. Nodes 236 represent the connection made when AC power contact 132 (shown in FIG. 4) is connected with AC power contact receptor 128 (shown in FIG. 4). DPDT switches are shown in a "Heat" position such that multi-voltage circuit 112 is enabled to heat split coil heating element 104. When DPDT switches are set to a "Charge" position, multi-voltage heating circuit 112 is disabled and charging circuit 212 is enabled. Current from the AC voltage source can then be utilized to charge battery pack 26.

Although the present invention has been described in reference to a portable generator, application of the invention should not be so limited. It is envisioned that the invention is applicable to any portable device that utilizes an internal combustion engine, for example a compressor or pump.

The present invention thus provides a relatively low cost means for allowing the heating of oil of an internal combustion engine of a portable generator through the use a removable/portable universal battery pack. Advantageously, the present invention can be used with a plurality of different battery packs of varying voltages.

While the invention has been described in terms of various specific embodiments, those skilled in the art will recognize that the invention can be practiced with modification within the spirit and scope of the claims.

What is claimed is:

1. A system for heating a fluid in an internal combustion engine, said system comprising:

a portable universal battery pack adapted to output a voltage having a specified voltage rating;

a receiving unit adapted to receive said battery pack and generate an electrical heating signal; and an immersion heater connected to said receiving unit and responsive to said electrical heating signal, said heater comprising a heating element adapted to be at least partially immersed in the fluid to heat the fluid in response to said electrical heating signal.

2. The system of claim 1, wherein said receiving unit is further adapted to modulate the voltage output from said battery pack such that low current power is provided to said heater, regardless of the specified voltage rating of said battery pack.

3. The system of claim 2, wherein the specified voltage rating of said battery pack ranges from about 8 VDC to about 36 VDC.

4. The system of claim 2, wherein the specified voltage rating of said battery pack ranges from about 12 VDC to about 24 VDC.

5. The system of claim 1, wherein said heating element comprises a split coil heating element adapted to utilize power from at least one of said battery pack and an AC power source to generate heat, thereby heating the fluid.

6. The system of claim 5, wherein said receiving unit comprises a multi-voltage circuit adapted to transmit power received from at least one of said battery pack and the AC power source to said split coil heating element.

7. The system of claim 5, wherein said receiving unit comprises a multi-voltage and battery charging circuit adapted to transmit power received from at least one of said battery pack and the AC power source to said split coil heating element, and to utilize power from the AC power source to charge said battery pack.

8. A method for heating fluid in an internal combustion engine, said method comprising:

attaching an immersion heater to the engine such that a heating element of the heater is at least partially immersed in the fluid;

providing a receiving unit connected to the heater for receiving a universal battery pack having a specified output voltage rating; and heating the heating element utilizing power provided by the portable universal battery pack having a specified output voltage rating to thereby heat the fluid.

9. The method of claim 8, wherein the a universal battery pack is removably inserted into the receiving unit.

10. The method of claim 8, wherein heating the heating element comprises modulating the voltage output from the universal battery pack such that a predetermined low current power is provided to the heater, regardless of the specified output voltage rating of the universal battery pack.

11. The method of claim 10, wherein heating the heating element further comprises heating the heating element utilizing a universal battery pack having an output voltage rating ranging from about 8 VDC to about 36 VDC.

12. The method of claim 10, wherein heating the heating element further comprises heating the heating element utilizing a universal battery pack having an output voltage rating ranging from about 12 VDC to about 24 VDC.

13. The method of claim 8, wherein heating the heating element comprises utilizing power from at least one of the universal battery pack and an AC power source to heat the heating element.

14. The method of claim 13, wherein the receiving unit includes a multi-voltage and battery charging circuit, and wherein heating the heating element further comprises:

transmitting power received from at least one of the universal battery pack and the AC power source to the split coil heating element utilizing the multi-voltage circuit; and charging the universal battery pack utilizing the multi-voltage and battery charging circuit and power from the AC power source.

15. A portable electric generator system comprising:

an internal combustion engine comprising a crank case adapted to contain fluid for lubricating and cooling said engine;

an immersion heater adapted to be coupled to said engine such that a heating element of said heater is at least partially immersed in the fluid;

a receiving unit connected to said heater via a multi-conductor electrical cable; and a portable universal battery pack adapted to couple with said receiving unit and to output a voltage having a specified voltage rating that is utilized to heat said heating element, thereby heating the fluid.

16. The system of claim 15, wherein said receiving unit is adapted to:

receive the output voltage from said battery pack;

modulate the voltage output received from said battery pack; and provide predetermined low current power to said heater, regardless of the specified battery voltage rating.

* * * * *